United States Patent [19]

Yeh

[11] Patent Number: 4,757,739

[45] Date of Patent: Jul. 19, 1988

[54] BELLOWS TYPE TOY TAMBOURINE

[76] Inventor: Thomas Yeh, 6th Fl., No. 210 An-Ho Rd., Taipei, Taiwan

[21] Appl. No.: 907,383

[22] Filed: Sep. 15, 1986

[51] Int. Cl.[4] ..... G10D 13/02

[52] U.S. Cl. ..... 84/418; 84/376 R; 84/411 R; 84/412; 84/420

[58] Field of Search ..... 84/411 P, 411 R, 412, 84/418, 420, 376 R, 376 A

[56] References Cited

U.S. PATENT DOCUMENTS

| | | | |
|---|---|---|---|
| 1,214,171 | 1/1917 | King | 84/412 |
| 2,603,120 | 7/1952 | Rosenheim | 84/376 R |
| 4,402,248 | 9/1983 | Pearce | 84/411 R |

*Primary Examiner*—Benjamin R. Fuller

*Attorney, Agent, or Firm*—Cushman, Darby & Cushman

[57] ABSTRACT

A bellows type toy tambourine with a bellows containing a space enclosed by two ring members. One of these ring members has a plurality of slots along its circumference. Each of these slots contains two round metal plates for giving metal collision sound by shaking while it is played as a tambourine. One of the ring members has a plurality of flues. Each of these flues is incorporated with a tongue so that different tunes can be given when the bellows is expanded or contracted to permit air to pass through the flues; i.e., when it is used as an accordion. It is a novel structure of toy instrument and a combination of toy drum, tambourine and accordion.

9 Claims, 2 Drawing Sheets

FIG. 5
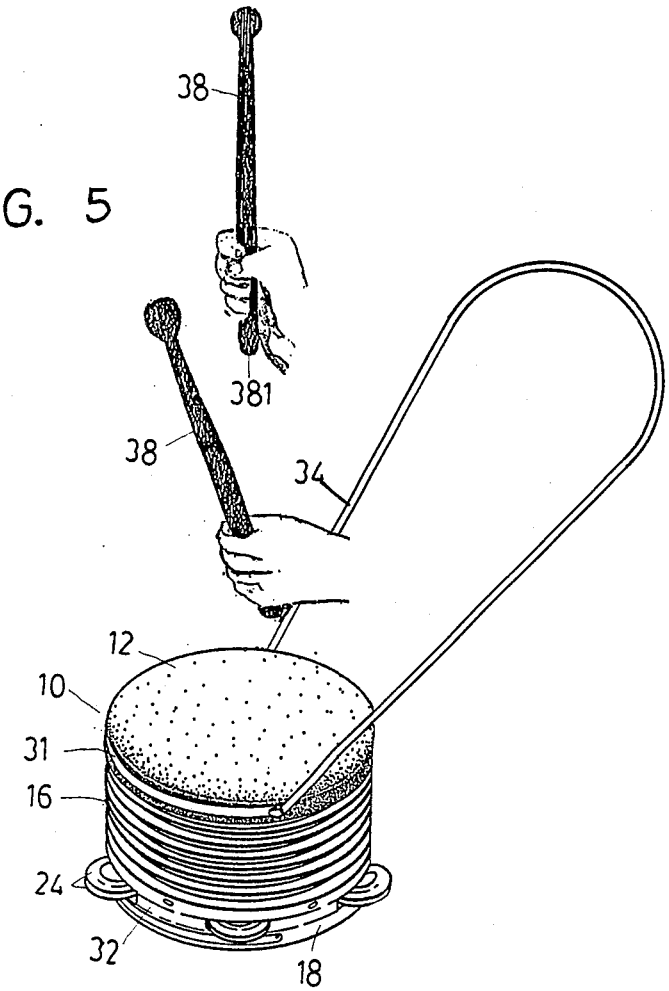
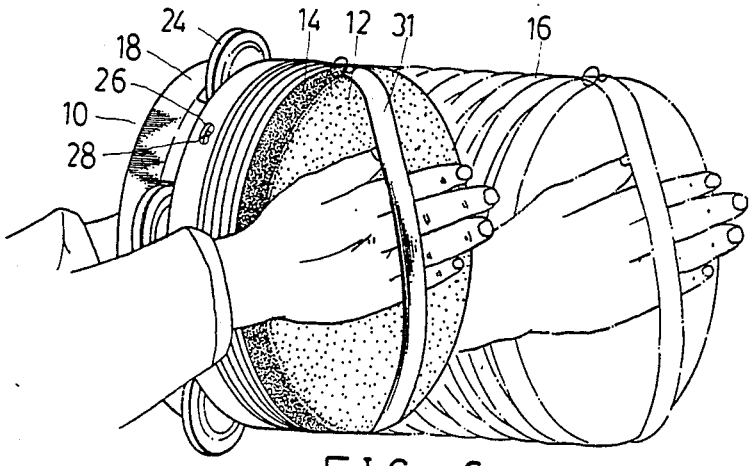
FIG. 6

BELLOWS TYPE TOY TAMBOURINE

BACKGROUND OF THE INVENTION

The present invention relates to a toy drum or tambourine. Particularly, the invention relates to a toy tambourine with a bellows suitable for playing as a tambourine, drum and accordion by children.

Toy instruments, such as a drum, organ, gong, flute, tambourine and the like have simple structures. None of them is as versatile as the latest intellectual toys. It has been hard to find novel toy music instruments. Therefore, the present invention should be considered a new and particularly versatile toy.

SUMMARY OF THE INVENTION

The major objective of the present invention is to provide a bellows-type tambourine which can be played as a toy drum, tambourine and accordion.

Another objective of the present invention is to provide a bellows-type tambourine which is a drum while the bellows is expanded and a tambourine while the bellows is contracted.

Another objective of the present invention is to provide a bellows-type tambourine which has a nice appearance, is compact in size and light in weight and which can be packaged and carried easily.

Therefore, in order to achieve the above objectives, the bellows-type toy tambourine according to the present invention comprises:

a first ring member with a drumhead made of leather, fabric, paper or plastic film;

a bellows made of leather, fabric, paper or plastic film, connected to the ring member;

a second ring member similar to the aforesaid one, connected to the bellows.

A space in the bellows is enclosed by the ring members and drumheads. The space is expandable and contractable in its axial direction.

The invention is further characterized by a plurality of slots along the circumference of a ring member. Each of the slots contains two round metal plates to give a metallic collision sound by shaking for playing as a tambourine.

The invention is further characterized by a plurality of flues along the circumference of a ring member, each of the flues is provided with a tongue so that expansion and contraction of the bellows will permit air to pass therethrough and to produce different tones for playing as an accordion.

Detailed description and other characteristics are given below with reference to a preferred embodiment in the attached drawings.

BRIEF DESCRIPTION OF DRAWINGS

FIG. 5 illustrates hanging of the bellow-type toy tambourine over the body of a child.

FIG. 6 illustrates operation of the bellows-type toy tambourine by two hands for playing as an accordion.

DETAILED DESCRIPTION OF THE PREFERRED EMBODIMENT

Figure 1:
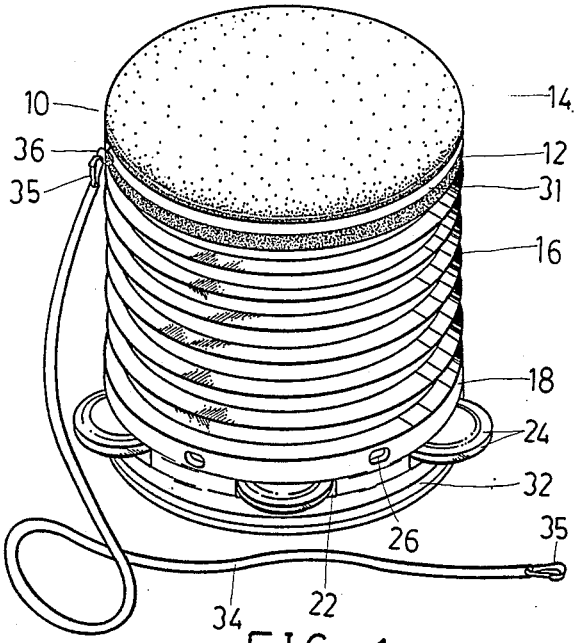
FIG. 1 is a perspective view of an embodiment of the present invention.
Figure 2:
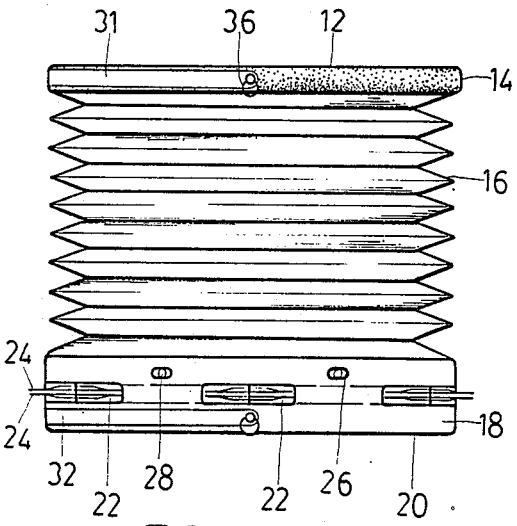
FIG. 2 is a front view of the embodiment of the present invention shown in FIG. 1.
Figure 3:
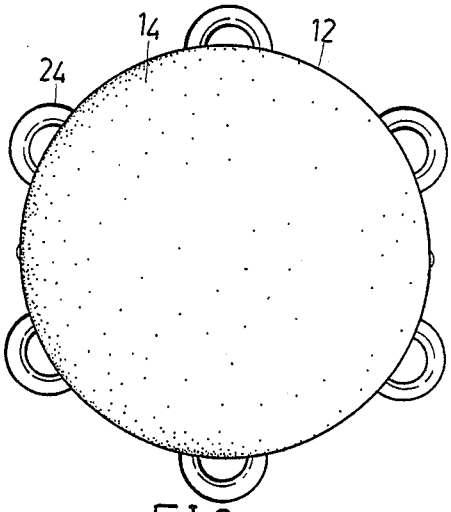
FIG. 3 is a top view of the embodiment shown in FIG. 1.

As shown in FIGS. 1–3, the bellows-type tambourine 10 comprises a ring member 12 with a drumhead 14 made of leather, or paper, or plastic sheet, or the like. The drumhead has an appropriate elasticity for generating a drumbeat when hit. The tambourine 10 also comprises bellows 16 made of leather, paper, or plastic film having an appropriate flexibility to permit expansion and contraction. One end of bellows 16 is fixed to the ring member 12 and another end to another ring member 18. Ring member 18 is provided with a drum head 20, and a plurality of slots 22 along its circumference. Each of these slots 22 contains two round metal plates 24 to give a metal collision sound. The slots 22 also comprise a plurality of flues 26. Each of the flues 26 is provided with a tongue 28. The tongue 28 can be either an integrated part of the flue 26 or an independent part.

The bellows 16 defines a space enclosed by the first ring member 12, the second ring member 18, and the drumheads 14, 20. Air can flow into and out of the space through the flues 26. A belt 31 is fixed to the first ring member 14 with both ends fastened to its circumference. Another belt 32 is fixed to the second ring member 18 in the same manner. The first member 12 has two hangers 36 to which a shoulder strap 34 with hooks 35 are connected.

Operation of the present invention is described below.

Figure 4:
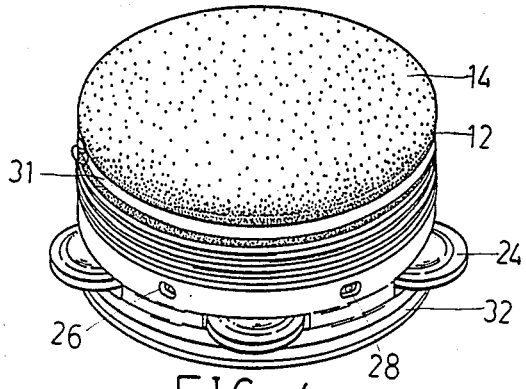
FIG. 4 is a perspective view of the bellows-type tambourine in the contracted condition.

As shown in FIG. 4, after contracting bellows 16, the bellows type tambourine 10 can be shaken or hit by hand to give a metal collision sound or drumbeat. That is, the present invention may be used as a toy tambourine.

As shown in FIG. 5, while the shoulder strap 34 is put over a child's body, the bellows 16 extends downward to a certain length by the weight of the second ring member 18. The child can hit the drumhead 12 with drumsticks 38. That is, the present invention may be used as a toy drum. According to the present invention, the drumstick 38 can be made in the form of a flute to give sound by blowing into end 381.

As shown in FIG. 6, after putting the belts 31, 32 over the drumheads 14, 20 respectively, a hand can be placed between the belt 31 and the drumhead 14 and another hand between the belt 32 and the drumhead 20 in order to expand and contract the bellows 16 so that air can be sucked and discharged through the flues 26, and passed through tongues 28 in order to generate different tones. That is, the present invention may be used as a toy accordion.

In conclusion, the bellows-type tambourine according to the present invention is a novel toy, a combination of drum, tambourine and accordion, accompanied by two drumsticks which can be played as flutes. It is a versatile instrument. Its structure is light and compact; packaging and carriage are easy.

Furthermore, the shoulder strap 34 can be fastened to the second ring member 18 or the flues 26 can be put on the first member 14 instead of that described above.

The embodiment of the present invention particularly disclosed and described herein above is presented merely as an example of the invention. It is obvious to those skilled in the art that various changes and modifications may be made therein, without departing from the invention. It is, therefore, aimed in the claims to cover all such changes and modifications as fall within the true spirit and scope of the present invention.

What is claimed is:

1. A bellows-type toy tambourine comprising:

a first ring member having a periphery;

a first drumhead stretched over the periphery of said first ring member, said first drumhead made of a material having an elasticity appropriate for generating a drum beat;

a second ring member having a periphery;

a second drumhead stretched over the periphery of said second ring member, said second drumhead made of said material having an elasticity appropriate for generating a drum beat;

an expandable and contractable bellows having a first end attached to said first ring member and a second end attached to said second ring member such that said first and second ring members and said bellows define an interior space, wherein one or both of said first and second ring members comprise means for allowing air into said interor space, such that air is expelled from the interior space when the bellows is contracted and drawn into the space when the bellows is expanded.

2. A toy tambourine as claimed in claim 1, wherein at least one of said ring members further comprises a plurality of slots along its periphery and metal means for making a metal collision sound disposed in each slot.

3. A toy tambourine as claimed in claim 1, wherein said means for allowing air into said interior space comprises a plurality of flue means along its periphery for generating tones when said bellows are contracted or expanded and air is expelled or drawn into said interior space.

4. A tambourine according to claim 1, wherein said material is paper.

5. A tambourine according to claim 2, wherein said metal means comprises two round metal plates.

6. A tabourine according to claim 3, wherein said flue means comprise tongues for generating a tone when air is expelled or drawn into said interior space.

7. A tambourine according to claim 1, wherein said material is leather.

8. A tambourine according to claim 1, wherein said material is fabric.

9. A tambourine according to claim 1, wherein said material is plastic film.

* * * * *